US005997412A

United States Patent [19]

Benson

[11] Patent Number: 5,997,412

[45] Date of Patent: Dec. 7, 1999

[54] EXTENSIBLE GOLF CLUB

[76] Inventor: Shawn B. Benson, 15326 W. 92 Pl., Lenexa, Kans. 66219

[21] Appl. No.: 08/986,895

[22] Filed: Dec. 8, 1997

[51] Int. Cl.[6] ..... A63B 53/12

[52] U.S. Cl. ..... 473/296; 473/239; 473/316

[58] Field of Search ..... 473/47, 48, 239, 473/288, 296, 300, 316, 306, 307, 322, 323

[56] References Cited

U.S. PATENT DOCUMENTS 1,994,069 3/1935 Fletcher ..... 473/316

3,829,092 8/1974 Arkin ..... 473/239

5,282,619 2/1994 Napolitano et al. ..... 473/239

*Primary Examiner*—William M. Pierce

*Attorney, Agent, or Firm*—Hovey, Williams, Timmons & Collins

[57] ABSTRACT

A golf club which includes interconnected segments which can be added to extend the length thus providing an inexpensive alternative to buying new golf clubs. The segments are securely connected to achieve a rigid and sturdy golf club which can grow longer as a child grows taller. The segments preferably have a threaded male/female connection with epoxy applied to the threads followed by the added security of a roll pin inserted into the connection.

10 Claims, 2 Drawing Sheets

EXTENSIBLE GOLF CLUB

BACKGROUND OF THE INVENTION

1. Field of the Invention

This invention relates to a golf club which is extensible in length. This invention allows a child to start playing golf with a short golf club and to simply add new segments to lengthen the club as the child grows rather than buying new, longer clubs.

2. Description of the Prior Art

Golf is enjoyed as both a competitive sport and as an exercise activity. The age group of people taking up golf has become younger. This is particularly true due to the recent successes of young professional golfers which has made the game popular among children and parents. Manufacturers have responded to this demand by producing golf clubs in a variety of lengths which will accommodate people of all sizes. However, buying a club of a shorter length does not allow a child to use the club for very long. As the young golfer grows, he or she must continually replace the club as it becomes too short. There is accordingly a need for a golf club having an extensible length which can be increased as the child's height increases. This golf club must also be sturdy and rigid in order to provide maximum benefit to the child's game.

Some U.S. patents which show variations to shafts of golf clubs are U.S. Pat. Nos. 5,029,860; 5,609,336; 5,282,619; 5,328,174; 5,024,438; 5,496,029; 1,650,183; 3,102,726; and 3,424,464. None of the above patents disclose a device which uses a plurality of segments to increase the length of a golf club.

SUMMARY OF THE INVENTION

In a preferred embodiment of the invention, the lower section of the upper shaft of the club ends with a collar which has a threaded male projection that can fit into a threaded female opening of a spacer segment. The connection is secured by a roll pin which is permanently inserted in a hole in the barrel of the spacer segment and through a hole in the threaded male projection, the end result being the addition of permanent growth or extension which cannot be disassembled. New spacer segments can continually be added by placing the threaded female opening of each new spacer segment over the threaded male projection of the last-attached spacer segment. A roll pin used as described above secures the connection. The upper section of the lower shaft of the club ends with a collar which has a threaded female opening to receive the threaded male projection of the bottom or last-attached spacer segment. This connection is secured with a removable roll pin which can be removed to permit the addition of more spacer segments as the child grows.

In a particularly preferred embodiment of the invention, the threaded male projections are about ¾ of an inch long and the male/female connections are further secured by the application of an epoxy to the threads prior to connection.

BRIEF DESCRIPTION OF THE DRAWINGS

FIG. 3 is a fragmentary sectional view depicting one spacer segment connecting the upper and lower shafts of the golf club; and.

DETAILED DESCRIPTION OF THE PREFERRED EMBODIMENT

Figure 1:
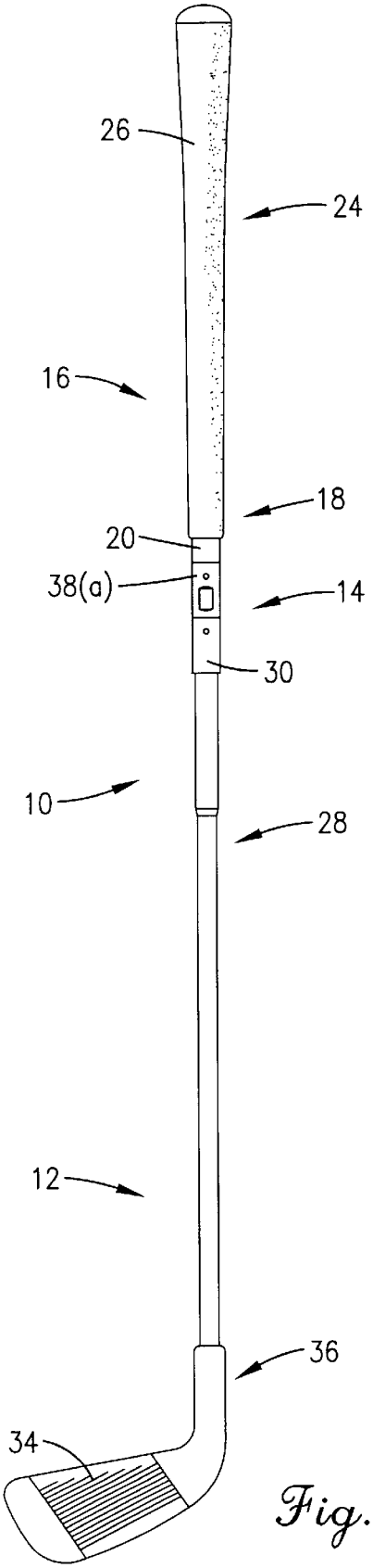
FIG. 1 is an elevational view of the golf club embodying the present invention with one spacer segment in place.

Turning now to the drawings, FIG. 1 shows a golf club 10. Broadly speaking, the golf club 10 includes a lower shaft 12, a midsection 14, and an upper shaft 16.

Upper shaft 16 of golf club 10 has a lower end 18 fitted with a first collar 20. First collar 20 terminates in a threaded male projection 22 (shown in FIG. 2) which has a pin hole 23. FIG. 1 illustrates an upper end 24 of upper shaft 16 covered with a handle 26.

Lower shaft 12 has an upper end 28 which terminates in a second collar 30. Second collar 30 has a pin hole 31 and a threaded female opening 32 (shown in FIG. 2). FIG. 1 illustrates the club head 34 which is attached to a lower end 36 of the lower shaft 12.

Figure 2:
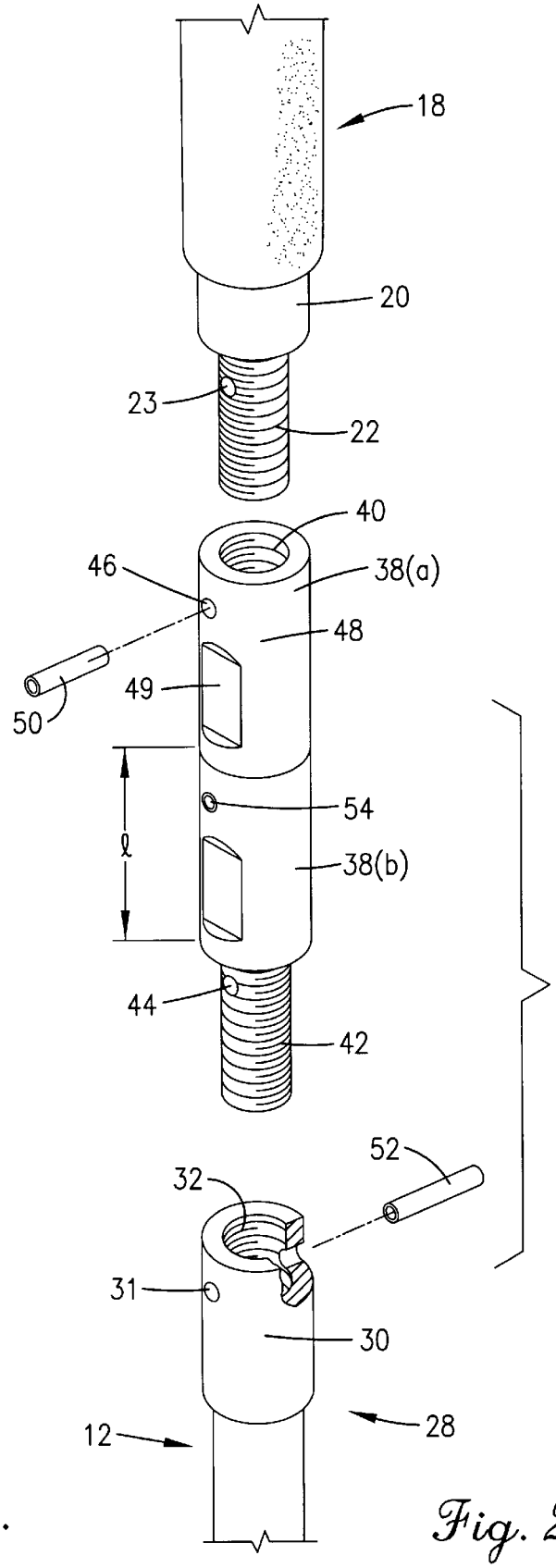
FIG. 2 is an exploded fragmentary view with parts broken away of the upper and lower shaft portions of the invention connected by two spacer segments.
Figure 4:
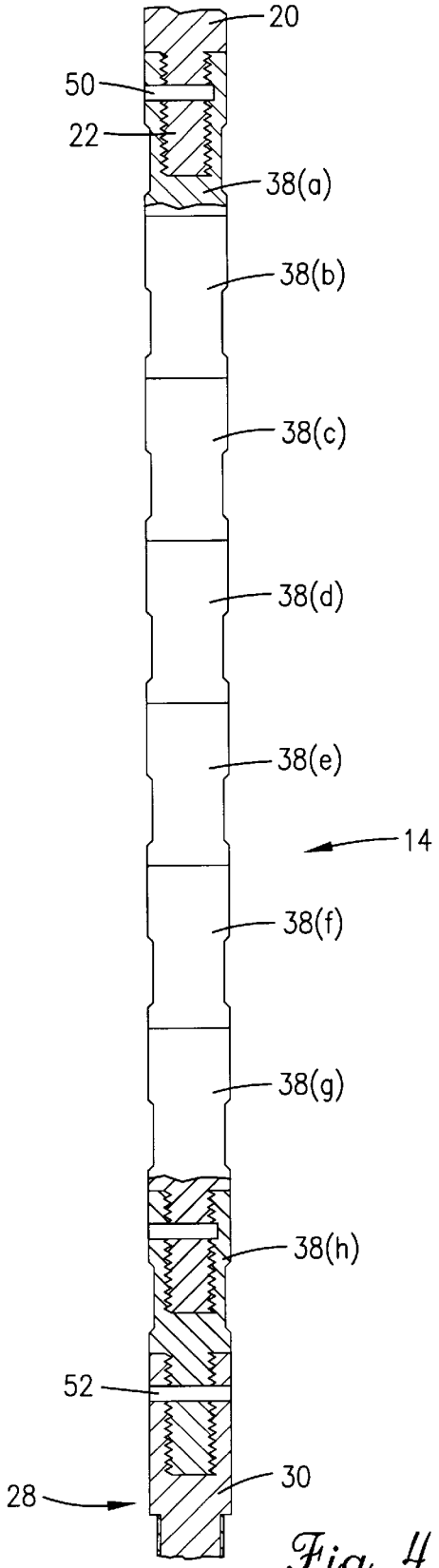
FIG. 4 is a fragmentary view in partial vertical section illustrating how the upper shaft, eight spacer segments, and the lower shaft are connected when the club is in its maximum extended form.

Midsection 14 is composed of spacer segment 38(*a*) in FIG. 1. In FIG. 2, midsection 14 contains spacer segment 38(*a*) and spacer segment 38(*b*). Referring to FIG. 4, the midsection 14 has spacer segments 38(*a*) through 38(*h*). Turning to FIG. 2, spacer segment 38(*a*) has a threaded female opening 40 and a threaded male projection (not shown). Spacer Segment 38(*b*) has a threaded female opening (not shown) and a threaded male projection 42. Each spacer segment added to the golf club 10 has a similar structure and further includes a pin hole 44 on its threaded male projection, a pin hole 46 on its barrel 48, and a wrench flat 49.

Referring to FIG. 2, spacer segment 38(*a*) has a threaded female opening which threadably receives threaded male projection 22. A roll pin 50 is inserted through pin hole 46 of spacer segment 38(*a*) and pin hole 23 of the threaded male projection 22, thus reinforcing the connection.

Still referring to FIG. 2, second collar 30 has a threaded female opening 32 for threadably receiving the threaded male projection 42 of second spacer segment 38(*b*). Threaded male projection 42 has a pin hole 44 through its entire diameter, and second collar 30 has a pin hole 31 which is reflected across the threaded female opening 32 (shown in breakaway) thus permitting a removable roll pin 52 to be inserted when threaded male projection 42 is threadably received by threaded female opening 32. This secures second spacer segment 38(*b*) to second collar 30 of lower shaft 12.

In a preferred embodiment, each threaded male projection is about ¾ of an inch in length, and the barrel 48 has a length (|) of about 1 inch. The spacer segments can be of varying sizes and lengths, but preferably they are substantially similar to one another.

FIG. 2 also illustrates how the spacer segments look when connected to one another. Spacer segment 38(*b*) has a threaded female opening (not shown) which receives the threaded male projection (not shown) of spacer segment 38(*a*). A roll pin 54 is inserted through spacer segment 38(*b*) and the male projection (not shown) of spacer segment 38(*a*) resulting in a secure connection between the two spacer segments. This connection can be repeated numerous times between many spacer segments. Flat 49 is provides a gripping surface for tightening the connections.

In a preferred embodiment of this invention, the golf club length can be potentially increased by up to eight spacer segments as shown in FIG. 4 where spacer segments 38(*a*)–38(*h*) are interconnected by the same male/female and roll pin connection described above. Spacer segment 38(*a*) is secured to a first collar 20 by a roll pin 50. Eighth spacer segment 38(*h*) is secured to a second collar 30 by a removable pin 52.

Figure 3:
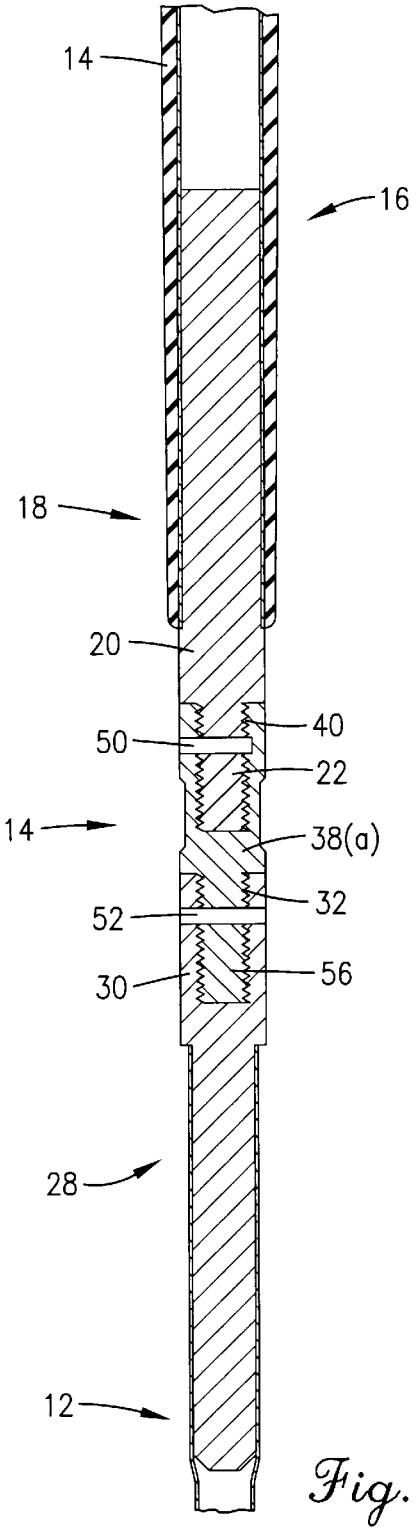

FIG. 3 shows a sectional view of the connections when the golf club is lengthened by only one spacer segment. An upper shaft 16 is covered by a handle 14. A lower end 18 of upper shaft 16 ends in a first collar 20. An upper end 28 of lower shaft 12 is fitted with a second collar 30. A spacer segment 38(*a*) has a threaded female opening 40 which threadably receives a threaded male projection 22 of first collar 20. This connection is secured by a roll pin 50. Second collar 30 has a threaded female opening 32 which threadably receives a threaded male projection 56 of spacer segment 38(*a*). This connection is secured by a removable roll pin 52. Each time a user wishes to lengthen the golf club, he or she can withdraw removable roll pin 52 and add another spacer segment by putting the new spacer segment's threaded female opening over the threaded male projection of the most recently attached spacer segments. The user then connects the new spacer segment's threaded male projection to second collar 30 by way of the above described male/female connection followed by reinsertion of removable roll pin 52.

It will be appreciated that this unusual feature of adding segments permits a child to use the same golf club for quite some time. Furthermore, club head 34 (FIG. 1) could be any golf head that the user desires, not just the one shown. Placing an amount of epoxy on the male/female connection and inserting a roll pin through that connection provides the same strong, rigid shaft of a one piece golf club. These features save money for the families of children who play golf and give children from a wide range of economic backgrounds the ability to afford quality equipment.

I claim:

1. An extensible golf club comprising:

a club head;

a normally lower shaft attached to said club head;

a handle;

a normally upper shaft attached to said handle; and a plurality of selectively interconnected spacer segments coupling said normally lower shaft to said normally upper shaft, each of said spacer segments having a female opening and a male projection, the uppermost spacer segment presenting a first female opening and the lowermost segment having a terminal male projection and said female opening is threaded and said male projection is threaded.

2. An extensible golf club as described in claim 1, wherein said interconnected spacer segments are eight in number.

3. An extensible golf club as described in claim 1, wherein said male projection is about ¾ of an inch in length.

4. An extensible golf club as described in claim 1, wherein said spacer segments are substantially the same length.

5. An extensible golf club as described in claim 1, wherein said spacer segments comprise a barrel segment defining a female opening therein, and a male projection, said barrel having a length of about 1 inch.

6. An extensible golf club as described in claim 1, wherein each of said spacer segment have a barrel segment defining a female opening therein, a male projection, and a structure defining a pair of aligned, pin-receiving holes in the sidewall of said barrel and said male projection respectively and a locking pin received with said aligned holes.

7. An extensible golf club as described in claim 1, wherein said normally lower shaft has a first collar presenting a female opening for receiving said terminal male projection and said normally upper shaft has a second collar having a male projection for coupling with said first female opening.

8. An extensible golf club comprising:

a club head;

a normally lower shaft attached to said club head;

a handle;

a normally upper shaft attached to said handle; and a plurality of interconnected spacer segments coupling said normally lower shaft to said normally upper shaft, each of said spacer segments having a barrel segment defining a female opening therein, a male projection, and a structure defining a pair of aligned, pin-receiving holes in the sidewall of said barrel and said male projection respectively and a locking pin received with said aligned holes.

9. An extensible golf club having an increasable operational length comprising:

a club head;

a normally lower shaft attached to said club head;

a handle;

a normally upper shaft attached to said handle;

a plurality of selectively interconnected spacer segments coupling said normally lower shaft to said normally upper shaft; additional spacer segments being interconnected to increase the operational length of the golf club;

each of said spacer segments having a female opening and a male projection, the uppermost spacer segment presenting a first female opening and the lowermost segment having a terminal male projection; and said female opening is threaded and said male projection is threaded.

10. An extensible golf club having an increasable operational length comprising:

a club head;

a normally lower shaft attached to said club head;

a handle;

a normally upper shaft attached to said handle;

a plurality of selectively interconnected spacer segments coupling said normally lower shaft to said normally upper shaft additional spacer segments being interconnected to increase the operational length of the golf club; and each of said spacer segments has a barrel segment defining a female opening therein, a male projection, and a structure defining a pair of aligned, pin-receiving holes in the sidewall of said barrel and said male projection respectively and a locking pin received with said aligned holes.

* * * * *